US006054859A

United States Patent [19]

Takahashi et al.

[11] Patent Number: 6,054,859

[45] **Date of Patent: *Apr. 25, 2000**

[54] COMBUSTION STATE DETECTING APPARATUS FOR INTERNAL COMBUSTION ENGINE

[75] Inventors: Yasuhiro Takahashi; Wataru Fukui, both of Tokyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/743,398

[22] Filed: Nov. 1, 1996

[30] Foreign Application Priority Data

Jun. 3, 1996 [JP] Japan ..... 8-140438

[51] Int. Cl.[7] ..... F02P 17/00

[52] U.S. Cl. ..... 324/399; 324/464; 73/35.08; 73/23.31

[58] Field of Search ..... 324/399, 464; 123/630, 481; 73/35.08, 23.31

[56] References Cited

U.S. PATENT DOCUMENTS

| | | | |
|---|---|---|---|
| 5,309,884 | 5/1994 | Fukui | 123/481 |
| 5,388,560 | 2/1995 | Hisaki | 324/399 |
| 5,548,220 | 8/1996 | Kawamoto | 324/399 |
| 5,592,926 | 1/1997 | Miyata | 123/630 |

FOREIGN PATENT DOCUMENTS

| | | | |
|---|---|---|---|
| 4133015A1 | 4/1992 | Germany | F02P 3/04 |
| 4136835A1 | 5/1992 | Germany | F02P 11/02 |
| 4241471A1 | 6/1993 | Germany | F02P 11/06 |
| 2104978 | 7/1990 | Japan | F02P 17/00 |
| 4-54283 | 2/1992 | Japan . | |
| 5-44624 | 2/1993 | Japan | 324/378 |

*Primary Examiner*—Josie Ballato
*Assistant Examiner*—Jose M. Solis
*Attorney, Agent, or Firm*—Sughrue, Mion, Zinn, Macpeak & Seas, PLLC

[57] ABSTRACT

A combustion state detecting apparatus for an internal combustion engine is capable of ensuring a satisfactory ion current detection sensitivity and reliability by preventing discharge of bias voltage to an ignition coil to thereby protect the bias voltage against lowering. The apparatus includes an ignition coil for generating a firing voltage, spark plugs to which the firing high-voltage is applied via a high-voltage supply circuitry connected to an output terminal of the ignition coil, a biasing device connected to the high-voltage supply circuitry for applying a bias voltage to the spark plug, a bias voltage protection device inserted between the output terminal of the ignition coil and the biasing device, an ion current detecting device for detecting ions generated in succession to discharging of the spark plug upon application of the firing high-voltage as an ion current which flows through the spark plug under the bias voltage applied to the spark plug, and an electronic control unit for detecting combustion state on the basis of detected value of the ion current.

4 Claims, 2 Drawing Sheets

COMBUSTION STATE DETECTING APPARATUS FOR INTERNAL COMBUSTION ENGINE

BACKGROUND OF THE INVENTION

1. Field of the Invention

The present invention relates to an apparatus for detecting combustion state of or quality an internal combustion engine on the basis of a change in an ion current which is generated upon combustion of an air-fuel mixture in the engine. More particularly, the invention is concerned with a combustion state detecting apparatus for an internal combustion engine which is provided with a means for preventing a bias voltage applied to an electrode of a spark plug for detecting the ion current from lowering, to thereby ensure high reliability for the detection of ion current and hence the combustion state or quality of the engine.

2. Description of Related Art

In general, in the internal combustion engine including a plurality of cylinders, an air-fuel mixture is charged into a combustion chamber defined within each of the engine cylinders to be subsequently compressed during a compression stroke by a piston moving reciprocatively within the cylinder. Subsequently, a high voltage is applied to a spark plug of the cylinder, whereby a spark is generated between electrodes of the spark plug due to electric discharge. Thus, combustion of the compressed air-fuel mixture is triggered. Explosion energy resulting from the combustion is then converted into a movement of the piston in the direction reverse to that of the compression stroke, which motion is translated into a torque outputted from the internal combustion engine via a crank shaft.

Upon combustion of the compressed air-fuel mixture within the engine cylinder, molecules prevailing within the combustion chamber are ionized. Thus, by applying a bias voltage to an ion current detecting electrode (which is usually constituted by an electrode of the spark plug and which is mounted as exposed to the interior of the combustion chamber, an amount of ions carrying electric charges flows between the electrodes of the spark plug. Thus, an ion current is generated.

As is known in the art, magnitude of the ion current varies with a high sensitively in dependence on the combustion state or quality within the combustion chamber. By taking advantage of this phenomenon, the combustion state within the engine cylinder can discriminatively be identified or determined by detecting behaviors or attributes of the ion current such as a peak value thereof and the like.

The combustion state detecting apparatus for the internal combustion engine of the type mentioned above is disclosed, for example, in Japanese Unexamined Patent Application Publication No. 104978/1990 (JP-A-2-104978). More specifically, there is disclosed in this publication an apparatus for detecting such abnormality of the engine operation as typified by occurrence of the misfire on the basis of the ion current detected immediately after the combustion by using the electrodes of the spark plug as the electrodes for detecting the ion current.

The bias voltage for detecting the ion current has to be applied to the spark plug with a same polarity as a high firing voltage (i.e., voltage for firing the air-fuel mixture) via a diode capable of withstanding a high voltage. In this conjunction, it is however noted that the spark plug is connected to the output terminals of the secondary winding of an ignition coil for which is employed applying the high voltage to the spark plug.

As is apparent to those skilled in the art, upon starting of a current supply to a primary winding (i.e., start of energization of the primary winding) of the ignition coil, a voltage is induced in the secondary winding with a polarity reverse to that of the secondary voltage induced upon interruption of the primary current. Consequently, there may arise such an unwanted situation that the bias voltage is lowered because a discharge current will then flow to the ignition coil.

Such lowering of the bias voltage may equally take place even when a high-voltage distribution system is adopted in which a firing high-voltage is applied to the spark plug via a distributor, because of possibility of discharge from the peripheral electrodes to the center electrode of the distributor.

As will now be apparent from the above, the conventional combustion state detecting apparatus for the internal combustion engine known heretofore suffers a problem that when the ion current detection unit is connected to the secondary winding of the ignition coil the peripheral electrodes of the distributor, a voltage having a polarity reverse to that of the firing voltage is generated upon starting of the electric energization of the ignition coil. Thus, the bias voltage can not be prevented from lowering due to discharge of the bias voltage to the ignition coil, which is of course disadvantageous in that sensitivity and reliability for the ion current detection and hence for the combustion state determination are thereby degraded.

SUMMARY OF THE INVENTION

In the light of the state of the art described above, it is an object of the present invention to provide a combustion state detecting apparatus for an internal combustion engine, which apparatus is capable of ensuring a satisfactory ion current detection sensitivity and reliability by preventing or suppressing discharge of the bias voltage to the ignition coil to thereby protect the bias voltage against lowering.

In view of the above and other objects which will become apparent as the description proceeds, there is provided according to an aspect of the present invention a combustion state detecting apparatus for an internal combustion engine, which apparatus includes an ignition coil unit for generating a high firing voltage (i.e., a high voltage for triggering combustion of an air-fuel mixture), at least one spark plug to which the firing high-voltage is applied via a voltage supply circuitry connected to an output terminal of the ignition coil unit, a biasing means connected to the high-voltage supply circuitry for applying a bias voltage to the spark plug(s), a bias voltage protection means inserted between the output terminal of the ignition coil and the biasing means, an ion current detecting means for detecting ions generated in succession to discharging of the spark plug(s) upon application of the firing voltage as an ion current which flows through the spark plug(s) under the bias voltage applied thereto, and an electronic control unit for detecting combustion state or quality in an engine cylinder provided with the spark plug on the basis of detected value of the ion current, wherein the bias voltage protection means prevents the bias voltage from lowering, to thereby ensure soundness or reliability of the ion current detection signal.

In a preferred mode for implementing the combustion state detecting apparatus for an internal combustion engine which includes a plurality of cylinders provided with spark plugs, respectively, the ignition coil unit is composed of a primary winding which has one end connected to a power supply source, a secondary winding which is electromagnetically coupled to the primary winding and a power transistor which is connected to the primary winding for turning on/off a primary current flowing through the primary winding in response to an ignition signal, wherein the high firing voltage is induced in the secondary winding upon interruption of the primary current flowing through the primary winding. The high-voltage supply circuitry includes a distributor having a center electrode connected to an end of the secondary winding from which the firing high-voltage is outputted and a plurality of peripheral electrodes disposed around the center electrode each with a gap in opposition thereto, wherein a plurality of spark plugs are connected to the peripheral electrodes, respectively. The biasing means may include a plurality of high-voltage diodes connected to the spark plugs, respectively, so as to apply the bias voltage to each of the spark plugs with same polarity as that of the firing voltage, and a capacitor electrically connected to an end of the primary winding of the ignition coil for charging therein a primary current supplied from the primary winding upon interruption of the primary current, to thereby serve as a bias voltage source. The ion current detecting means may be so designed as to detect an ion current in each of the spark plugs by applying the bias voltage thereto via associated one of the high-voltage diodes. The electronic control unit generates an ignition signal on the basis of operating state information of the internal combustion engine and detects combustion state within each of the engine cylinders on the basis of the relevant ion current detection signal. The bias voltage protection means may include a bias voltage protection diode inserted between the secondary winding of the ignition coil and the center electrode of the distributor in order to prevent the capacitor from being discharged in the direction toward the ignition coil.

In another preferred mode for implementing the combustion state detecting apparatus for the internal combustion engine which includes a plurality of engine cylinders provided with spark plugs, respectively, the engine cylinders are classified into a plurality of cylinder groups. The ignition coil unit includes a plurality of subunits corresponding to the cylinder groups, respectively, wherein each of the ignition coil subunits includes a primary winding having one end connected to a power supply source and a secondary winding electromagnetically coupled to the primary winding and a power transistor connected to an end of the primary winding of the ignition coil for turning on/off a primary current flowing through the primary winding in response to an ignition signal. The firing voltage is induced in the secondary winding upon interruption of the primary current flowing through the primary winding. The spark plugs are grouped into a plurality of pairs corresponding to the cylinder groups and connected in each pair to both ends of the secondary winding, respectively. The biasing means may include a plurality of high-voltage diodes connected to the spark plugs belonging to the cylinder groups, respectively, so as to apply the bias voltage to each of the spark plugs with the same polarity as that of the firing voltage with respect to one of each pair of the spark plugs, and capacitors which are electrically connected to an end of the primary winding of each of the ignition coil units for charging therein a voltage supplied from the primary windings, respectively, as the bias voltages upon interruption of the primary currents, respectively. The ion current detecting means may be so designed as to detect flows of ion currents in the spark plugs of the cylinder groups by applying the bias voltages thereto via the high-voltage diodes. The electronic control unit is adapted to generate the ignition signal on the basis of operating state information of the internal combustion engine and detect the combustion state or quality within each of the engine cylinders on the basis of the relevant ion current detection signals. The bias voltage protection means may include bias voltage protection resistors inserted between the secondary windings of the ignition coil and high-voltage diodes in parallel with the bias voltage protection resistors, respectively, in order to prevent the capacitor from being discharged in the direction to the ignition coil.

With the arrangements of the combustion state detecting apparatus for the internal combustion engine described above, the bias voltage can effectively be prevented from lowering, whereby enhanced sensitivity can be ensured for the detection of the ion current, which in turn means that the combustion state or quality of the internal combustion engine can be detected with high reliability.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
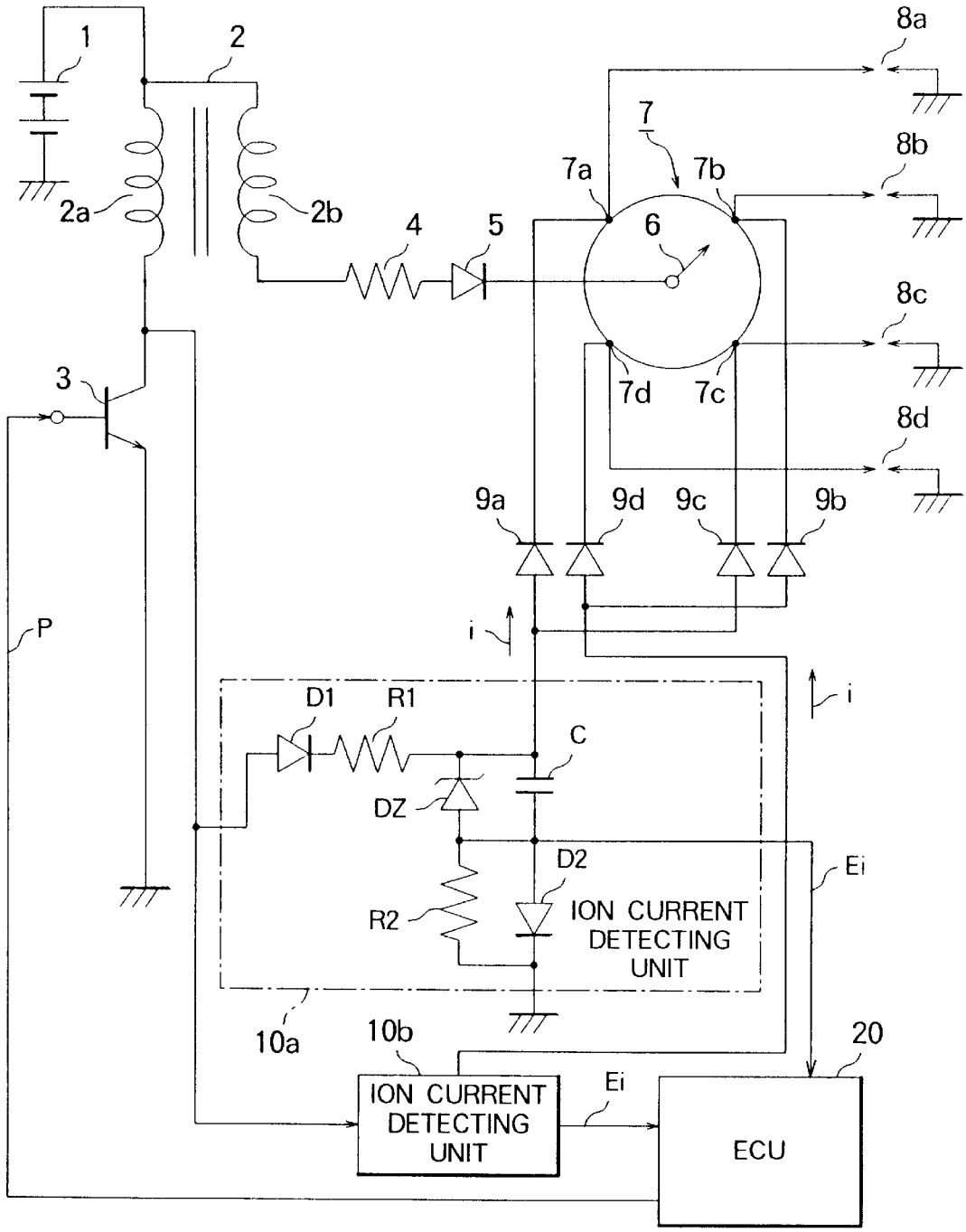
FIG. 1 is a block diagram showing generally a configuration of a combustion state detecting apparatus for an internal combustion engine according to a first embodiment of the present invention.

Now, the present invention will be described in detail in conjunction with what is presently considered as preferred or typical embodiments thereof by reference to the drawings. In the following description, like reference characters designate like or corresponding parts throughout the several views.

Embodiment 1

FIG. 1 is a block diagram showing generally a configuration of a combustion state detecting apparatus for an internal combustion engine according to a first embodiment of the invention. In the instant embodiment of the invention, it is presumed that a high voltage is applied distributively to ignition plugs or spark plugs of the individual engine cylinders, respectively, by way of a distributor.

Referring to FIG. 1, an anode of an onboard battery 1 constituting a power supply source is connected to a low-voltage terminal of an ignition coil 2 to which a primary winding 2*a* and a secondary winding 2*b* thereof are connected in common. Hereinafter, this terminal will be referred to also as the common terminal. To other end or terminal of the primary winding 2*a* is connected to the ground potential via a power transistor 3 which serves for turning on/off the primary current.

On the other hand, the other end (high-voltage side) of the secondary winding 2*b* which serves as an output terminal for a high firing voltage (i.e., voltage for firing an air-fuel mixture) outputted from the ignition coil 2 is connected to a noise-suppression series circuit which is composed of a resistor 4 and a diode 5 and hence to a center electrode 6 of a distributor 7 which includes peripheral electrodes 7*a* . . . , 7*d* corresponding to a plurality of cylinders (four cylinders in the illustrated case), respectively.

The bias voltage protection diode 5 serves for preventing a bias voltage for detection of an ion current from being discharged to the ignition coil 2, as will be described in more concrete later on. In other words, the diode 5 functions as a bias voltage protecting diode.

The center electrode 6 is so positioned as to face successively in opposition to the peripheral electrodes 7*a* . . . , 7*d* with a gap, respectively, as an output shaft of the internal combustion engine rotates. Connected to the peripheral electrodes 7*a* . . . , 7*d* are spark plugs 8*a* . . . , 8*d*, respectively, which are provided in association with the individual engine cylinders, respectively, wherein high-voltage diodes 9*a* . . . , 9*d* (i.e., diode capable of withstanding a high voltage) are connected to the spark plugs 8*a* . . . , 8*d*, respectively, for applying a bias voltage with a same polarity as that of the firing voltage.

A pair of high-voltage diodes 9*a* and 9*c* of the high-voltage diodes 9*a* to 9*d* have respective anodes connected to an ion current detecting unit 10*a*, while the anodes of the other high-voltage diodes 9*b* and 9*d* in pair are connected to the other ion current detecting unit 10*b* which is implemented in a same configuration as the ion current detecting unit 10*a*. Parenthetically, in FIG. 2, the circuit configuration of only the ion current detecting unit 10*a* is shown representatively of the other unit 10*b*.

As can be seen from FIG. 1, the ion current detecting unit 10*a* is comprised of a rectifier diode D1 connected to the other end of the primary winding 2*a*, a current limiting resistor R1 connected in series to the rectifier diode D1, a voltage limiting Zener diode DZ connected in series to the resistor R1, a rectifier diode D2 inserted between the Zener diode DZ and the ground, a capacitor C connected in parallel with the Zener diode DZ, and an output resistor R2 connected in parallel with the rectifier diode D2. Needless to say, the ion current detecting unit 10*b* is implemented essentially in a same configuration as the ion current detecting unit 10*a*.

The series circuit composed of the rectifier diode D1, the resistor R1, the capacitor C and the rectifier diode D2 is inserted between the one end of the primary winding 2*a* of the ignition coil 2 and the ground, wherein the series circuit mentioned above constitutes a charging current path through which a charging current flows to the capacitor C.

In the state where the power transistor 3 is non-conducting or off, the capacitor C is supplied with a voltage from the battery 1 via the primary winding 2*a* of the ignition coil 2 to be thereby charged to a predetermined bias voltage (several hundred voltages) under voltage limiting function of by the Zener diode DZ. In this manner, the capacitor C functions as a power source (biasing means) for detecting an ion current i.

The output resistor R2 incorporated in both the ion current detecting units 10*a* and 10*b*, respectively, serves for converting the ion current i to a corresponding voltage which is inputted to the electronic control unit 20 as an ion current detection signal Ei.

The electronic control unit 20 which may be constituted by a microcomputer determines the combustion state or quality of the internal combustion engine on the basis of the ion current detection signal Ei. When unsatisfactory combustion state or quality is detected, the electronic control unit 20 performs an appropriate control for avoiding such poor combustion quality and hence inconvenience as brought about thereby.

Further, the electronic control unit 20 is so programmed as to determine arithmetically an ignition timing and others on the basis of the engine operating state information signals obtained from various sensors (not shown) and generate not only an ignition signal P to be applied to the switching control terminal (gate) of power transistor 3, but also a fuel injection signal applied to each of fuel injectors (not shown) provided in association with the individual engine cylinders, respectively, as well as driving signals supplied to a variety of actuators provided for a throttle valve, an ISC valve and others, respectively.

Now, referring to FIG. 1, operation of the combustion state detecting apparatus according to the instant embodiment of the invention will be described.

Ordinarily, the electronic control unit 20 arithmetically determines the ignition timing and others in accordance with the engine operation state to apply the ignition signal P to the power transistor 3 at a desired control timing for thereby controlling on/off-operation of the power transistor 3. More specifically, the power transistor 3 is turned off in response to the ignition signal P, whereby the primary current flowing through a primary winding 2*a* of the ignition coil 2 when the transistor 3 is conducting or on is interrupted. As a result of this, a primary voltage appearing across the primary winding 2*a* rises up steeply, whereby a secondary voltage having a high voltage level (several ten kilovolts) is induced in the secondary winding 2*b* of the ignition coil 2.

The secondary voltage is distributed from the center electrode 6 of the distributor 7 through the peripheral electrodes 7*a*, . . . 7*d* to the spark plugs 8*a*, . . . 8*d* of the individual engine cylinders, respectively, which results in generation of the spark discharge within the combustion chamber of the cylinder undergoing the ignition control, whereby combustion of the air-fuel mixture is triggered. In that case, when the combustion state is normal, a predetermined amount of ions is generated around the spark plug within the combustion chamber.

On the other hand, the bias voltage charged in the capacitor C when the power transistor 3 is turned off upon ignition control is applied to the relevant one of the spark plugs 8*a*. . . , 8*d* via the associated one of the high-voltage diodes 9*a* . . . , 9*d* in the ion current detection mode which follows immediately the ignition control (interruption of the primary current) of the ignition coil 2.

In other words, the capacitor C is discharged, to bring about migration or move of ions between the electrodes of spark plugs immediately after the combustion/explosion stroke to thereby allow an ion current i to flow.

Under the effect of the bias voltage applied from the capacitor C, the ion current i flows through a current path extending from the ground potential to the high-voltage diode 9*a* or 9*d* through the output resistor R2 and the capacitor C. At that time, the ion current detection signal Ei resulting from voltage conversion of the ion current i by the output resistor R2 is inputted to the electronic control unit 20 to be utilized for the decision of the combustion state or quality.

As is apparent from the foregoing, by inserting the bias voltage protection diode 5 between the output terminal of the secondary winding 2*b* and the center electrode 6 of the distributor 7, discharge of the bias voltage from the capacitor C toward the ignition coil 2 can be prevented even when the voltage of a polarity reverse to that of the firing voltage (negative voltage in this case) is generated at the output terminal of the secondary winding 2*b* of the ignition coil 2 upon starting of the primary current flow through the ignition coil 2 (i .e., starting of the energization of the primary winding 2*a* thereof). Thus, the bias voltage is protected against lowering, whereby the ion current detection signal Ei can be obtained with high accuracy, which in turn means that the combustion state or quality can be determined with high reliability.

Although it has been assumed in the foregoing description that both the firing voltage (i.e., secondary voltage) applied from the secondary winding 2*b* of the ignition coil 2 and the bias voltage applied from the capacitor C are of positive (or plus) polarity, it can readily be understood that by connecting the high-voltage diodes 9*a*, . . , 9*d* and the bias voltage protection diode 5 with reverse polarity, the firing voltage and the bias voltage may assume negative polarity.

Furthermore, the foregoing description has been made on the assumption that the internal combustion engine is a four-cylinder engine, wherein the engine cylinders disposed in opposition are classified into two groups (i.e., one group of cylinders provided with the spark plugs 8*a* and 8*c*, respectively, and the other group of cylinders having the spark plugs 8*b* and 8*d*, respectively), wherein ion current i is detected by using the two ion current detecting units 10*a* and 10*b*, respectively. However, the invention is never restricted to the four-cylinder engine and it is also possible to increase or decrease the number of the ion current detecting unit in accordance with the number of the engine cylinders. To say in another way, the number of the cylinders which can be monitored by one ion current detection unit is never limited to two but may vary in dependence on the number of the cylinders of internal combustion engine of concern.

Embodiment 2

In the case of the combustion state detecting apparatus according to the first embodiment of the invention, there is adopted a high-voltage distribution scheme in which a high voltage is applied to each of the spark plugs 8*a* . . . , 8*d* by way of the distributor 7. It should however be understood that a low-voltage distribution system or a groupwise distribution system may equally be adopted.

Figure 2:
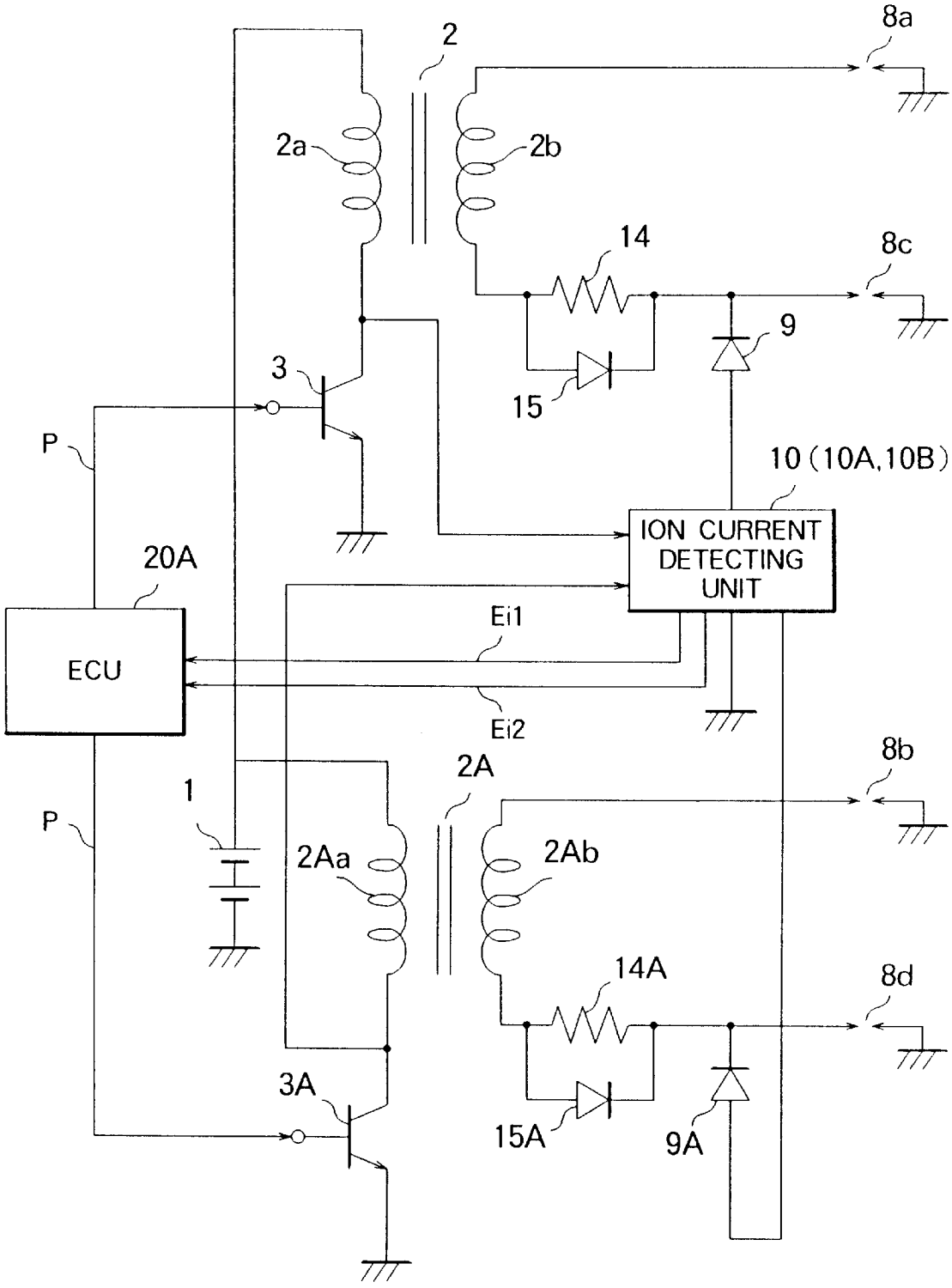
FIG. 2 is a schematic diagram showing generally a circuit configuration of the combustion state detecting apparatus according to a second embodiment of the present invention.

FIG. 2 is a schematic diagram showing generally a circuit configuration of the combustion state detecting apparatus according to a second embodiment of the invention in which a groupwise voltage distribution scheme is adopted. In the figure, the components designated by reference characters 1, 3, 8*a*, . . , 8*d*, 9A, 9B and 10 are essentially same as those described previously by reference to FIG. 1. Parenthetically, it is assumed that the bias voltage is supplied from the ion current detecting unit 10 with positive or plus polarity.

Referring to FIG. 2, there are provided in juxtaposition a pair of first and second ignition coils 2 and 2A in association with a first pair of spark plugs 8a and 8*c* and a second pair of spark plugs 8*b* and 8*d*, respectively, wherein the first pair of spark plugs 8*a* and 8*c* are connected to both ends of the secondary winding 2*b* of the first ignition coil 2, respectively, while the second pair of spark plugs 8*b* and 8*d* are connected to both ends of the secondary winding 2A*b* of the second ignition coil 2A.

On the other hand, the high-voltage diode 9 is connected to one electrode of the spark plug 8*c* with the high-voltage diode 9A being connected to one electrode of the spark plug 8*d* so that bias voltages can be applied to the spark plugs 8*c* and 8*d* with the same polarity as that of the firing voltage. It should further be added that the ion current detecting unit 10 is composed of two ion current detecting units 10*a* and 10*b* (subunits) as in the case of the first embodiment, although illustration is omitted.

The secondary windings 2*b* and 2A*b* of the ignition coils 2 and 2A have the ends of negative (minus) polarity which are directly connected to the spark plugs 8*a* and 8*b*, respectively, while the other ends (of positive (plus) polarity) of the secondary windings 2*b* and 2A*b* are connected to the spark plugs 8*c* and 8*d* by way of bias voltage protection resistors 14 and 14A, respectively, wherein firing diodes 15 and 15A are connected in parallel with the bias voltage protection resistors 14 and 14A, respectively, in the forward direction as viewed in the direction in which the secondary current of the ignition coil flows.

Further, the high-voltage diode 9 has a cathode connected to a junction between the spark plug 8*c* and the parallel connection of the bias voltage protection resistor 14 and the firing diode 15. On the other hand, the cathode of the high-voltage diode 9A is connected to a junction between the spark plug 8*d* and the parallel connection of the bias voltage protection resistor 14A and the firing diode 15A.

Thus, upon detection of the ion current, the spark plugs 8*c* and 8*d* are directly applied with the bias voltages from one ends of the high-voltage diodes 9 and 9A, respectively, whereas the spark plugs 8*a* and 8*b* are applied with the bias voltages by way of the bias voltage protection resistors 14 and 14A and the secondary windings 2*b* and 2A*b*, respectively.

Now, description will turn to operation of the combustion state detecting apparatus shown in FIG. 2 by paying attention representatively to the pair of spark plugs 8*a* and 8*c*. During the ordinary ignition control operation, the secondary current of the ignition coil 2 flows along a current path which extends from the spark plug 8*a* to the spark plug 8*c* through the secondary winding 2*b* and the firing diode 15, whereby the spark plugs 8*a* and 8*c* are applied with the firing voltages with polarities reverse to each other, respectively.

On the other hand, in the ion current detecting operation which immediately follows the ignition control, the ion current i can flow through only the spark plug of the cylinder in which the explosion stroke takes place in reality. In that case, because the bias voltage protection resistors 14 is inserted between the high-voltage diode 9 and the one end of the secondary winding 2*b*, the bias voltage is prevented from being discharged to the ignition coil 2 upon starting of the energization of the primary winding 2*a* of the ignition coil 2.

Thus, the ion current i can be detected with high accuracy, which of course means that the combustion state or quality of the internal combustion engine can be determined or identified with high reliability.

Although the foregoing description of the combustion state detecting apparatus according to the second embodiment of the invention has been made on the presumption that the bias voltage is applied with positive polarity, wherein the parallel circuits of the bias voltage protection resistor 14 and the firing diode 15 and the bias voltage protection resistor 14A and the firing diode 15A, respectively, are connected between one ends of the secondary windings 2*b* and 2A*b* and the one electrodes of the spark plugs 8*c* and 8*d*, respectively, it should be appreciated that the circuit arrangement for applying the bias voltage of negative polarity may equally be adopted. In that case, the bias voltage protection resistors 14 and 14A and the firing diodes 15 and 15A may be inserted between one ends of the secondary windings 2*b* and 2A*b* and the spark plugs 8*a* and 8*b*, respectively, with the forward direction of the high-voltage diodes 9 and 9A as well as that of the firing diodes 15 and 15A being reversed.

Furthermore, although description has been made on the presumption that the internal combustion engine is a four-cylinder engine and that a pair of ion current detecting units 10 are provided for two pairs of cylinders, respectively, it goes without saying that the number of the ion current detecting unit 10 may be increased or decreased in dependence on the number of the engine cylinders for detecting the ion currents.

Many modifications and variations of the present invention are possible in the light of the above techniques. It is therefore to be understood that within the scope of the appended claims, the invention may be practiced otherwise than as specifically described.

What is claimed is:

1. A combustion state detecting apparatus for an internal combustion engine, comprising:

an ignition coil unit generating a firing voltage at a high voltage output terminal;

high-voltage supply circuitry connected to at least two spark plugs;

biasing means for applying a bias voltage, via said high-voltage supply circuitry, to said at least two spark plugs;

bias voltage protection means for preventing said bias voltage from discharging through said ignition coil unit, said bias voltage protection means being connected in series between said high voltage output terminal and said high-voltage supply circuitry;

ion current detecting means for detecting, as an ion current, ions generated in succession to discharging of said at least two spark plugs upon application of said firing voltage, said ion current being a current which flows through said at least two spark plugs under said bias voltage; and an electronic control unit for detecting said combustion state, in an engine cylinder provided with said at least two spark plugs, on the basis of said ion current;

said internal combustion engine including a plurality of cylinders each provided with a respective one of a plurality of spark plugs, said plurality of spark plugs including said at least one spark plug;

said ignition coil unit including a primary winding having one end connected to a power supply source, and a secondary winding electromagnetically coupled to said primary winding;

a power transistor, connected to said primary winding of said ignition coil, and responsive to an ignition signal to turn on/off a primary current flowing through said primary winding;

means for inducing said firing voltage in said secondary winding upon interruption of said primary current;

said high-voltage supply circuitry including:

a distributor having a center electrode connected to said bias voltage protection means, and a plurality of peripheral electrodes disposed around said center electrode, each with a gap in opposition thereto;

said plurality of spark plugs being connected to said peripheral electrodes in correspondence to said cylinders, respectively;

said biasing means including a plurality of high-voltage diodes each respectively connected to a corresponding one of said plurality of spark plugs, each of said plurality of high-voltage diodes being connected so that said bias voltage to each of said plurality of spark plugs has the same polarity as said firing voltage;

said electronic control unit generating said ignition signal based on operating state information of said internal combustion engine and detects combustion state within each of said engine cylinders on the basis of the relevant ion current detection signal; and said bias voltage protection means comprising a bias voltage protection diode, wherein said bias voltage protection means further comprises a resistor connected in series, said resistor connected between said high voltage output terminal and said bias voltage protection diode.

2. The combustion state detecting apparatus according to claim 1, further comprising a capacitor electrically coupled to another end of said primary winding of said ignition coil for charging therein a voltage supplied from said primary winding as said bias voltage upon interruption of said primary current.

3. The combustion state detecting apparatus according to claim 1, further comprising capacitors electrically connected to one ends of said primary windings of said ignition coils, respectively, for charging therein a voltage supplied from said primary windings, respectively, as said bias voltages upon interruption of said primary currents, respectively.

4. A combustion state detecting apparatus for an internal combustion engine having spark plugs and corresponding cylinders, comprising:

ignition coil subunits for producing a firing voltage and each respectively comprising:

a primary winding connected to a power supply source and to a power transistor responsive to an ignition signal to turn on/off a primary winding current, a secondary winding electromagnetically coupled to said primary winding, having a first end connected to a respective first spark plug, and a second end corresponding to a respective second spark plug, and means for inducing said firing voltage in said secondary winding upon interruption of said primary winding current;

for one of said ignition coil subunits, said detecting apparatus having:

biasing means for applying a bias voltage to said respective second spark plug, said biasing means including a high-voltage diode connected to said respective second spark plug so that said bias voltage has the same polarity as said firing voltage, bias voltage protection means for preventing said bias voltage from discharging through said secondary winding, said bias voltage protection means including a bias voltage protection resistor connected in series between said second end of said secondary winding and said respective second spark plug, and ion current detecting means for detecting, as an ion current, ions generated in succession to discharging of said respective second spark plug upon application of said firing voltage, said ion current being a current which flows through said respective second spark plug under said bias voltage; and said detecting apparatus further comprising an electronic control unit for detecting said combustion state in said engine cylinder corresponding to said respective second spark plug on the basis of said ion current detection signal, and for generating said ignition signal based on operating state information of said internal combustion engine, wherein said bias voltage protection resistor is in parallel with said high-voltage diode.

* * * * *